US009102502B2

(12) United States Patent
Yamada et al.

(10) Patent No.: US 9,102,502 B2
(45) Date of Patent: Aug. 11, 2015

(54) DOUBLE-DECK ELEVATOR

(75) Inventors: Atsushi Yamada, Chiba-Prefecture (JP); Yasuhiro Goto, Chiba-Prefecture (JP)

(73) Assignee: Otis Elevator Company, Farmington, CT (US)

( * ) Notice: Subject to any disclaimer, the term of this patent is extended or adjusted under 35 U.S.C. 154(b) by 279 days.

(21) Appl. No.: 13/383,587

(22) PCT Filed: Dec. 9, 2009

(86) PCT No.: PCT/IB2009/007677
§ 371 (c)(1),
(2), (4) Date: Jan. 12, 2012

(87) PCT Pub. No.: WO2011/021065
PCT Pub. Date: Feb. 24, 2011

(65) Prior Publication Data

US 2012/0111671 A1 May 10, 2012

(30) Foreign Application Priority Data

Aug. 19, 2009 (JP) ..... 2009-189642

(51) Int. Cl.
*B66B 9/00* (2006.01)
*B66B 11/02* (2006.01)
*B66F 7/06* (2006.01)

(52) U.S. Cl.
CPC ..... *B66B 11/022* (2013.01); *B66F 7/0666* (2013.01)

(58) Field of Classification Search
CPC ..... B66B 20/00; B66B 11/0095; B66B 9/00; B66B 11/022; B66B 7/0666
USPC ..... 187/249, 291
See application file for complete search history.

(56) References Cited

U.S. PATENT DOCUMENTS 4,576,249 A * 3/1986 Zima ..... 182/82
5,907,136 A 5/1999 Hongo et al.

FOREIGN PATENT DOCUMENTS

CN 1225332 A 8/1999
CN 1850569 A 10/2006
EP 1074503 A2 2/2001

(Continued)

OTHER PUBLICATIONS

English Machine Translation of JP 2002-179368.*
English Machine Translation of JP 2000-211857 A.*
Chinese Search Report for Application No. 2009801601056.2 dated Jul. 11, 2013.

(Continued)

*Primary Examiner* — William E Dondero
*Assistant Examiner* — Diem Tran
(74) *Attorney, Agent, or Firm* — Carlson, Gaskey & Olds

(57) ABSTRACT

To provide a double-deck elevator characterized by the fact that by increasing the story height adjustment range in the direction in which the two cars approach each other, it is possible to increase the degree of building design freedom. Two up/down cars (6), (7) arranged in outer frame (5) are connected with each other by means of pantographic mechanisms (11) that can effect an expansion and contraction operation, and the two cars (6), (7) are driven to move towards each other or away from each other by means of pantographic mechanisms (11). The pantographic mechanisms (11) are arranged in the spaces between vertical beams (5*a*) and the two cars (6), (7) and each has a pivot point at the longitudinal central portion of vertical beams (5*a*) extending vertically in outer frame (5). Due to the pantographic mechanisms (11), the story height adjustment range in the direction in which the two cars (6), (7) approach each other is not restricted.

7 Claims, 3 Drawing Sheets

(56) References Cited

FOREIGN PATENT DOCUMENTS

| | | | | | |
|---|---|---|---|---|---|
| JP | 2000211857 | A | * | 8/2000 | ..... B66B 11/02 |
| JP | 2001080856 | | | 3/2001 | |
| JP | 2001328787 | A | | 11/2001 | |
| JP | 2002179368 | | | 6/2002 | |
| JP | 2002362858 | A | | 12/2002 | |
| JP | 2005145696 | A | | 6/2005 | |

OTHER PUBLICATIONS

International Preliminary Report on Patentability for International application No. PCT/IB2009/007677 mailed Mar. 1, 2012.
International Search Report and Written Opinion of the International Searching Authority for International application No. PCT/IB20091/007677 mailed Sep. 2, 2010.

* cited by examiner

DOUBLE-DECK ELEVATOR

TECHNICAL FIELD

The present invention pertains to a double-deck elevator having a 2-story structure made of two cars stacked as upper/lower cars. In particular, the present invention pertains to a double-deck elevator that allows adjustment of the story height by changing the distance between the two cars.

BACKGROUND ART

For example, the technology described in Japanese Unexamined Patent Application Publication No. 10-279231 has been proposed for a double-deck elevator of this type. According to this reference, two cars are arranged as upper/lower cars in an outer frame having a rectangular front shape that moves up/down in an elevator hoistway. The two upper/lower cars are connected to each other by a pantographic mechanism arranged between the two cars. The pivot point of the pantographic mechanism is arranged on a supporting frame connecting the intermediate portions in the longitudinal direction of the left/right vertical beams in the outer frame. According to this reference, the upper car is driven to move up/down by a driving means, so that the two cars are driven to move towards or away from each other via the pantographic mechanism so that the distance between the two cars is changed. As a result, it is possible to adjust the story height between the two cars corresponding to the story height of the landing floor of the lower car with this reference.

DISCLOSURE OF INVENTION

Technical Problem

Since the pantographic mechanism in this reference is arranged between the two cars in the double-deck elevator, the story height adjustment range is limited in the direction in which the two cars to approach each other, and such a double-deck elevator cannot be adopted in a building having floors with relatively small story height.

Technical Solution

The present invention provides a double-deck elevator characterized by the fact that the adjustment range of the story height in the direction in which the two cars approach each other is increased, so that the degree of building design freedom can be increased.

The invention described in claim 1 provides a double-deck elevator comprising a pair of cars arranged such that each can move up/down, a driving device that drives at least one of the two cars to move up/down, and a linking mechanism that is arranged to connect the aforementioned two cars with each other and that operates to move the two cars towards each other or away from each other; wherein the linking mechanism is located along sides of the cars.

Consequently, according to the invention described in claim 1, the linking mechanisms are arranged on the sides of the two cars, so that there is no need to have a supporting frame arranged between the two cars. Consequently, it enables a greater range of story height adjustment in the direction in which the two cars approach each other.

Advantageous Effects

According to the present invention, it is possible to expand the adjustment range of the story height in the direction in which the two cars approach each other, so that the double-deck elevator of the present invention can also be adopted in buildings with a relatively low story height. As a result, it is possible to dramatically increase the degree of building design freedom.

EXPLANATION OF REFERENCE

Figure 1:
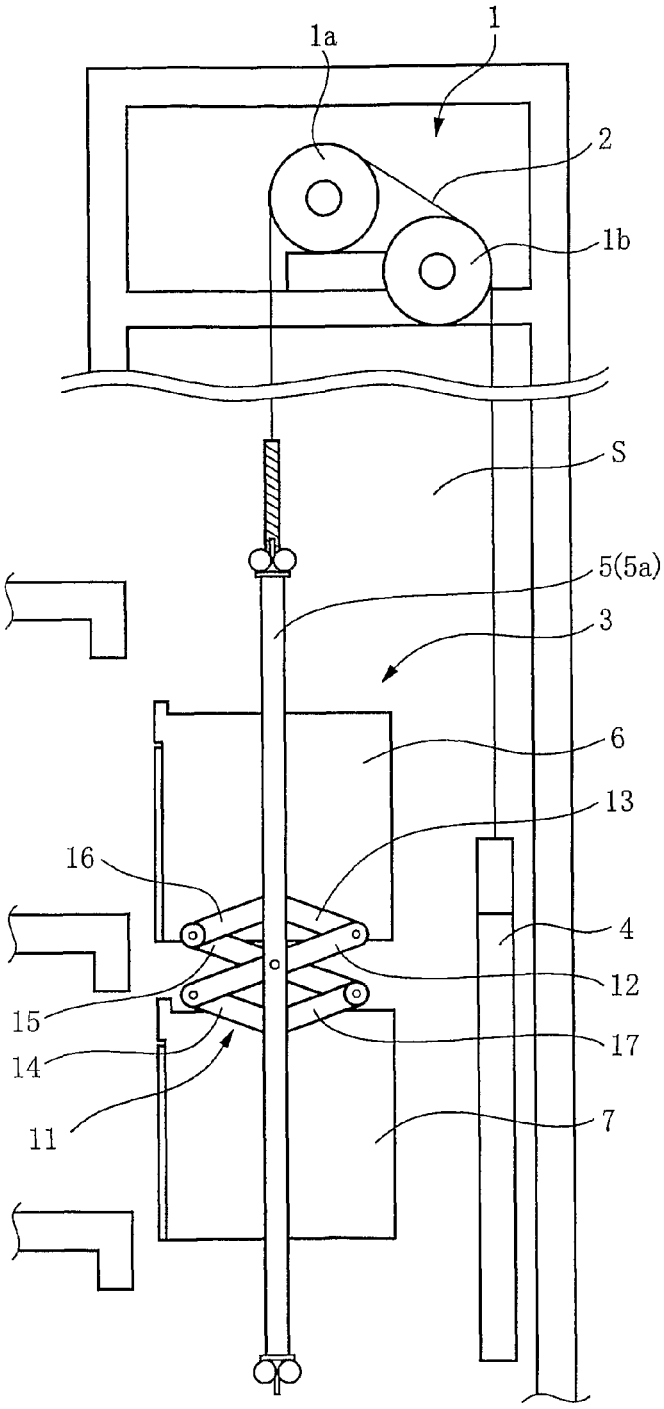
FIG. 1 is a schematic diagram illustrating the double-deck elevator as a preferred embodiment of the present invention.

5 Outer frame
5*a* Vertical beam of outer frame
6 Upper car
7 Lower car
11 Pantographic mechanism (linking mechanism)
12 First link member
13 Second link member
14 Third link member
15 Fourth link member
16 Fifth link member
17 Sixth link member
18 Pin (pivot point of pantographic mechanism)
21 Driving device

BEST MODE FOR CARRYING OUT THE INVENTION

Figure 2:
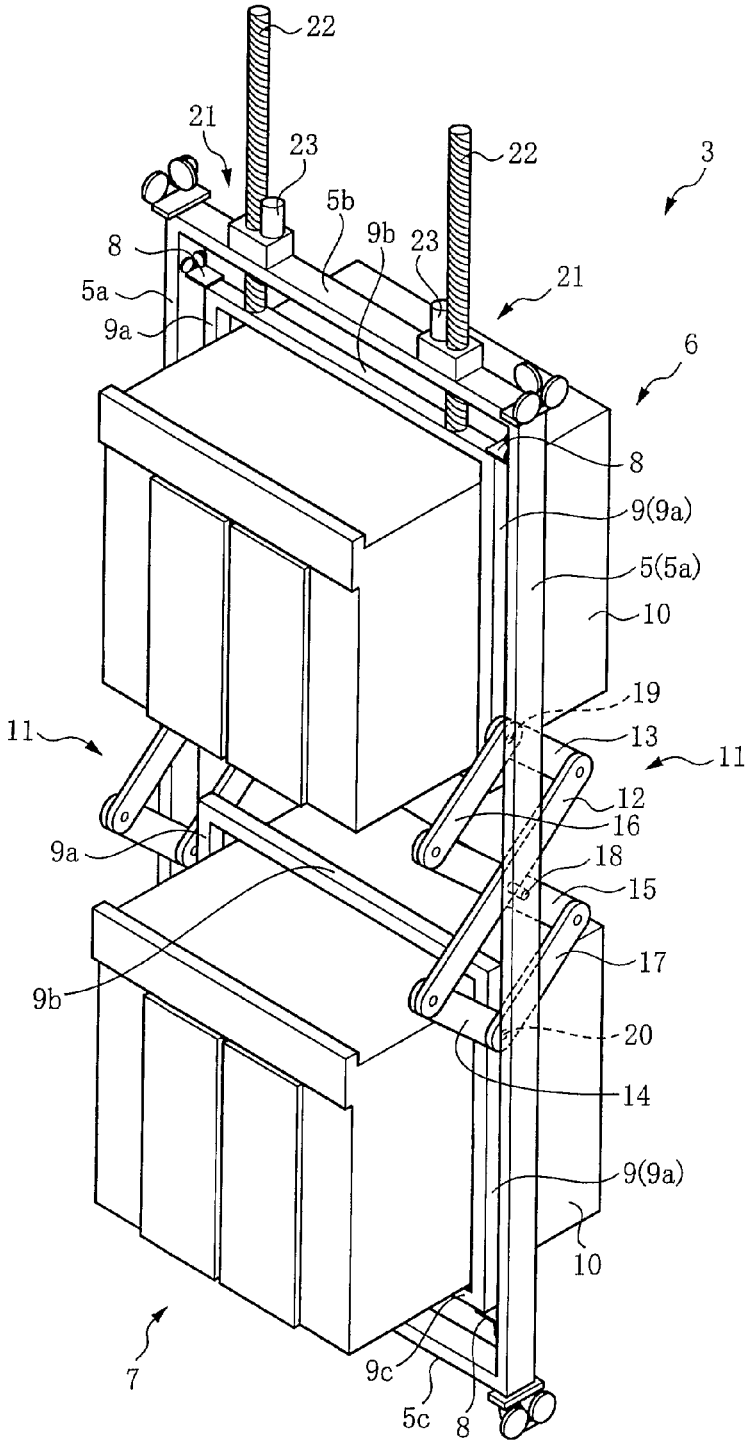
FIG. 2 is an oblique view of the car unit shown in FIG. 1.
Figure 3:
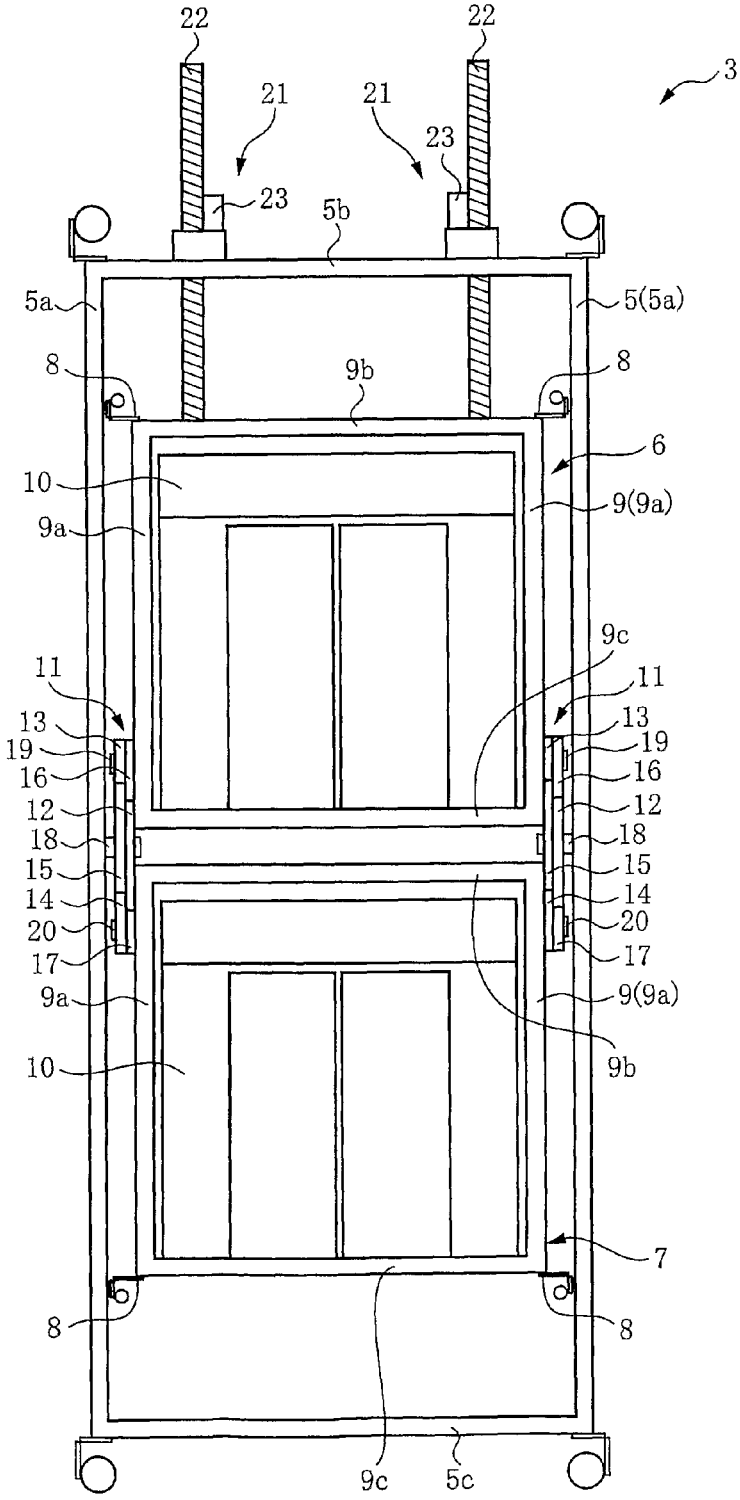
FIG. 3 is a front view of the car unit shown in FIG. 1.

FIGS. 1-3 are diagrams illustrating one possible embodiment of the present invention. More specifically, FIG. 1 is a schematic diagram illustrating the constitution of the double-deck elevator. FIG. 2 is an oblique view of the device shown in FIG. 1. FIG. 3 is a front view of the car unit shown in FIG. 1.

The double-deck elevator shown in FIG. 1 uses the so-called traction system. Car 3 is suspended from one end of main rope 2 running over drive sheave 1*a* and deflector sheave 1*b* of hoist 1, and counterweight 4 is suspended from the other end of main rope 2. As drive sheave 1*a* is driven to rotate by means of a motor not shown in the figure, car unit 3 and counterweight 4 are driven to move in elevator hoistway S while being guided by guide rails not shown in the figure.

In addition to FIG. 1, as shown in FIGS. 2, 3, car unit 3 is formed mainly of outer frame 5 having a rectangular front shape. A pair of cars consisting of upper car 6 and lower car 7 is arranged in the outer frame 5 such that each can move up/down. The outer frame 5 has a pair of left/right vertical beams 5*a* extending vertically, crosshead 5*b* connecting the upper ends of the two vertical beams 5*a*, and bolster 5*c* connecting the lower ends of two vertical beams 5*a*. Here, guide rollers 8 arranged on the two cars 6, 7 are guided such that the two cars 6, 7 can move up/down along two vertical beams 5*a* of outer frame 5. Also, although not shown in the figure, it is well known that one end of main rope 2 is connected to crosshead 5*b* of outer frame 5.

Each of the two cars 6, 7 has inner frame 9 having a rectangular front shape, and car chamber 10 arranged within the inner frame 9. The inner frame 9 has a pair of left/right vertical beams 9*a*, crosshead 9*b* connecting the upper ends of the two vertical beams 9*a*, and bolster 9*c* connecting the lower ends of two vertical beams 9*a*. As one example of a linking mechanism to connect the two cars 6, 7, pantographic mechanism 11 is arranged in each of the gaps between left/right vertical beams 9*a* of inner frames 9 of the two cars 6, 7 and left/right vertical beams 5*a* of outer frame 5. In other words, pantographic mechanism 11 is arranged on each of the left/right sides of the two cars 6, 7. Other linking mechanisms could be used with the present invention.

The two pantographic mechanisms 11 have nearly the same constitution. The pantographic mechanisms 11 are oriented such that their width direction corresponds to the depth direction of the two cars 6, 7. More specifically, the two pantographic mechanisms 11 have first and fourth link members 12, 15 arranged such that their central portions cross each other, with second and fifth link members 13 and 16 connecting the upper ends of first and fourth link members 12, 15, respectively, to upper car 6, and with third and sixth link members 14, 17 connecting the lower ends of first and fourth link members 12, 15, respectively, to lower car 7.

More specifically, while first link member 12 is arranged to incline downward going toward the front of the two cars 6, 7, that is, towards the exit/entry side of the two cars 6, 7, fourth link member 15 is arranged to incline upward going toward the front of the two cars 6, 7. The intersection between the first link member 12 and fourth link member 15 is rotatably connected to the longitudinal central portions of vertical beams 5*a* by means of common pin 18 in outer frame 5. Also, the upper ends of second link member 13 and fifth link member 16 are rotatably connected to the lower ends of vertical beams 9*a* by means of common pin 19 of inner frame 9 for upper car 6. In addition, the lower ends of third link member 14 and sixth link member 17 are rotatably connected to the upper ends of vertical beams 9*a* by means of common pin 20 of inner frame 9 for lower car 7.

As a result, a diamond shape is formed by the upper halves of first link member 12 and fourth link member 15 with second link member 13 and fifth link member 16. At the same time, a diamond shape is formed by the lower halves of first link member 12 and fourth link member 15 with third link member 14 and sixth link member 17. Also, the second link member 13 and fifth link member 16 of pantographic mechanism 11 overlap in the width direction of upper car 6 at the lower end of upper car 6. Additionally, third link member 14 and sixth link member 17 of pantographic mechanism 11 overlap in the width direction of lower car 7 at the upper end of lower car 7.

Here, with pin 18 serving as the pivot, pantographic mechanism 11 can move to extend in the depth direction of the two cars 6, 7 while contracting in the vertical direction, so that the two cars 6, 7 move towards each other. On the other hand, when pantographic mechanism 11 moves to contract in the depth direction of the two cars 6, 7 while extending in the vertical direction, the two cars 6, 7 move away from each other.

In this embodiment, pantographic mechanism 11 is used as the linking mechanism to drive the two cars 6, 7 to move towards each other or away from each other. However, a scheme can also be adopted in which first link member 12 through third link member 14 or fourth link member 15 through sixth link member 17 of pantographic mechanism 11 are omitted to form a crank mechanism, and the crank mechanism can be used as the linking mechanism.

In addition, a pair of up/down driving devices 21 for upper car 6 is arranged on crosshead 5*b* of outer frame 5. The two driving devices 21 each have threaded shaft 22 extending in the vertical direction. The threaded shaft 22 is inserted passing through crosshead 5*b* of outer frame 5, and the lower end of threaded shaft 22 is connected to crosshead 9*b* of inner frame 9 for upper car 6. Here, when electric motor 23 of driving device 21 is turned on, the screwing movement function of threaded shaft 22 drives up/down so that upper car 6 is driven to move up/down.

In this embodiment with the constitution, when car unit 3 operates, the story height between the two cars 6, 7 is adjusted according to the story height of the floor where lower car 7 is to land, so that the two cars 6, 7 can land at adjacent floors, respectively. More specifically, when the two driving devices 21 are used to drive upper car 6 to move up/down, pantographic mechanism 11 operates to drive the two cars 6, 7 to move in opposite directions, respectively, so that the distance between the two cars 6, 7, that is, the story height, can be quickly adjusted.

Here, the weight of lower car 7 acts on pantographic mechanism 11 to make the pantographic mechanism 11 extend in the vertical direction. On the other hand, the weight of upper car 6 acts on pantographic mechanism 11 to compress it in the vertical direction. As a result, the intrinsic weights of upper car 6 and lower car 7 cancel each other, so that electric motor 23 of driving device 21 needs only to drive according to the load difference between upper car 6 and lower car 7, so that the electric motor 23 for carrying out the operation can have a lower capacity.

Here, pantographic mechanism 11 is positioned so that it is not located between the two cars 6, 7. In one embodiment, and as shown the figures, pantograph mechanism is arranged along the sides of the two cars 6, 7 and more specifically in the space between vertical beams 5*a* of outer frame 5 and the two cars 6, 7. In other words, the pantographic mechanism 11 or other member is absent between the two cars 6, 7. Consequently, the adjustment range of the story height in the direction in which the two cars 6, 7 approach each other is not limited by the presence of pantographic mechanism 11.

Consequently, in this embodiment, it is possible to expand the adjustment range of the story height in the direction in which the two cars 6, 7 approach each other, so that the double-deck elevator can be adopted even in buildings with relatively small story height. As a result, the degree of building design freedom can be increased significantly by using the double-deck elevator.

Also, by arranging the pivot point of pantographic mechanism 11 on vertical beams 5*a* of outer frame 5, the supporting frame that used to be arranged between the two cars 6, 7 is no longer needed. As a result, outer frame 5 can be made smaller in size and lighter in weight, so that the system is favorable with respect to space reduction and energy consumption. This is an advantage.

The invention claimed is:

1. A double-deck elevator comprising:

two elevator cabs:

a frame that supports the cabs, the frame being at least partially situated on an outside of the cabs with spacing between the frame and the cabs, the frame being arranged in a hoistway such that the frame can move vertically for carrying the cabs along the hoistway;

a support member that supports the frame within the hoistway;

a machine associated with the support member, the machine causing selective movement of at least a portion of the support member for moving the frame and the elevator cabs along the hoistway a driving device that drives at ne of cabs to move relative to the other of the cabs;

a linking mechanism that operates responsive to the driving device to change a distance between the cabs, the linking mechanism including at least two link members and a pivot that facilitates movement of the two link members relative to each other;

wherein said linking mechanism is located along at least one side of the cabs and the pivot is within the spacing between the cabs and the frame;

wherein the frame includes a vertical beam and said pivot is situated in a longitudinal central portion of the vertical beam; and wherein said linking mechanism is arranged in a gap between said vertical beam and said two cabs.

2. A double-deck elevator comprising:

two elevator cabs;

a frame that supports the cabs. the frame being at least partially situated on an outside of the cabs with spacing between the frame and the cabs, the frame being arranged in a hoistway such that the frame can move vertically for carrying the cabs along the hoistway;

a support member that supports the frame within the hoistway;

a machine associated with the support member, the machine causing selective movement of at least a portion of the support member for moving the frame and the elevator cabs alone the hoistway;

a driving device that drives at least one of the two cabs to move relative to the other of the cabs;

a linking mechanism that operates responsive to the driving device to change a distance between the cabs, the linking mechanism including at least two link members and a pivot that facilitates movement of the two link members relative to each other;

wherein said linking mechanism is located along at least one side of the cabs and the pivot is within the spacing between the cabs and the frame; and wherein the linking mechanism has ends that are overlapped in a width direction of the two cabs.

3. The double-deck elevator of claim 2, wherein said linking mechanism expands and contracts about the pivot to move the cabs away from and toward each other, respectively, and the linking mechanism has a width in a depth direction of said two cabs, the width decreasing in conjunction with said expansion and the width increasing in conjunction with said contraction.

4. The double-deck elevator of claim 3, wherein the linking mechanism comprises:

a first link member that is rotatably connected to said pivot at a longitudinal central portion, a second link member that connects an upper end of said first link member with an upper one of the cabs, and a third link member that connects a lower end of said first link member with a lower one of the cabs.

5. The double-deck elevator of claim 4, wherein the linking mechanism is a pantographic mechanism that comprises:

a fourth link member that is arranged to cross said first link member and that is connected in a freely rotatable way to said pivot at the portion crossing the first link member, a fifth link member that connects an upper end of said fourth link member with the upper one of the cabs, and a sixth link member that connects a lower end of said fourth link member with the lower one of the cabs.

6. A double-deck elevator comprising:

two elevator cabs;

a frame that supports the cabs, the frame being at least partially situated on an outside of the cabs with spacing between the frame and the cabs, the frame being arranged in a hoistway such that the frame can move vertically for carrying the cabs along the hoistway;

a support member that supports the frame within the hoistway;

a machine associated with the support member, the machine causing selective movement of at least a portion of the support member for moving the frame and the elevator cabs along the hoistway a driving device that drives at least one of the two cabs to move relative o the other of the cabs; and a linking mechanism that operates responsive to the driving device to change a distance between the cabs, the linking mechanism including at least two link members and a pivot that facilitates movement of the two link members relative to each other;

wherein said linking mechanism is located along at least one side of the cabs and the pivot is within the spacing between the cabs and the frame wherein the linking mechanism is arranged on each of two sides in a width direction of said two cabs.

7. The double-deck elevator of claim 6, wherein the driving device is arranged on a crosshead that connects ends of vertical beams of the frame, and the driving device is used to drive the one of the cabs closest to the crosshead in a vertical direction.

* * * * *

UNITED STATES PATENT AND TRADEMARK OFFICE

CERTIFICATE OF CORRECTION

PATENT NO. : 9,102,502 B2
APPLICATION NO. : 13/383587
DATED : August 11, 2015
INVENTOR(S) : Atsushi Yamada et al.

It is certified that error appears in the above-identified patent and that said Letters Patent is hereby corrected as shown below:

IN THE CLAIMS:

Claim 1, column 4, line 64; should read as --a driving device that drives at least one of the two cabs to move relative to the other of the cabs;--

Claim 6, column 6, line 30; after “relative” replace “o” with --to--

Signed and Sealed this
First Day of March, 2016

Michelle K. Lee

Michelle K. Lee
*Director of the United States Patent and Trademark Office*